US008545006B2

(12) United States Patent
Mitsuzawa

(10) Patent No.: US 8,545,006 B2
(45) **Date of Patent: *Oct. 1, 2013**

(54) LIQUID EJECTING APPARATUS AND LIQUID EJECTING METHOD

(75) Inventor: Toyohiko Mitsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/449,207

(22) Filed: Apr. 17, 2012

(65) Prior Publication Data

US 2012/0262524 A1 Oct. 18, 2012

Related U.S. Application Data

(63) Continuation of application No. 12/691,694, filed on Jan. 21, 2010, now Pat. No. 8,177,350.

(30) Foreign Application Priority Data

Jan. 22, 2009 (JP) ..... 2009-012371

(51) Int. Cl.
*B41J 2/01* (2006.01)

(52) U.S. Cl.
USPC ..... 347/102; 347/37

(58) Field of Classification Search
None
See application file for complete search history.

(56) References Cited

U.S. PATENT DOCUMENTS

| | | | | |
|---|---|---|---|---|
| 6,953,245 | B2 | 10/2005 | Shirakawa | |
| 8,177,350 | B2 * | 5/2012 | Mitsuzawa | 347/102 |
| 2006/0007290 | A1 | 1/2006 | Oshima et al. | |
| 2008/0225101 | A1 | 9/2008 | Kumagai | |
| 2009/0284574 | A1 | 11/2009 | Niekawa | |

FOREIGN PATENT DOCUMENTS

| | | | |
|---|---|---|---|
| JP | 2000-158793 | A | 6/2000 |
| JP | 2005-104108 | A | 4/2005 |
| JP | 2005-224971 | A | 8/2005 |
| JP | 2005-313445 | A | 11/2005 |
| JP | 2006-181805 | A | 7/2006 |
| JP | 2008-087221 | A | 4/2008 |
| JP | 2008-265285 | A | 11/2008 |
| WO | 2005/032827 | A1 | 4/2005 |
| WO | 2007/148505 | A1 | 12/2007 |

* cited by examiner

*Primary Examiner* — Lamson Nguyen
(74) *Attorney, Agent, or Firm* — Kilpatrick Townsend & Stockton LLP

(57) ABSTRACT

A liquid ejecting apparatus includes (A) a carriage that moves a nozzle ejecting a liquid which is cured by irradiation of an electromagnetic wave in a moving direction, (B) a first irradiation section that is installed on the carriage and irradiates electromagnetic waves on dots formed by landing the liquid which is ejected from the moving nozzle, on a medium, and (C) a second irradiation section that is installed on the carriage and irradiates electromagnetic waves on the dots which are irradiated by the electromagnetic waves from the first irradiation section, in which an irradiance level of the electromagnetic waves from the second irradiation section is different from that of the electromagnetic waves from the first irradiation section.

9 Claims, 13 Drawing Sheets

IMAGE AFTER FIRST TEMPORARY CURING

IMAGE AFTER SECOND TEMPORARY CURING

LIQUID EJECTING APPARATUS AND LIQUID EJECTING METHOD

This application is a continuation of U.S. patent application Ser. No. 12/691,694, filed Jan. 21, 2010, and which claims the benefit of Japanese Patent Application No. 2009-012371, filed Jan. 22, 2009, the entireties of which are incorporated by reference herein.

BACKGROUND

1. Technical Field

The present invention relates to a liquid ejecting apparatus and a liquid ejecting method.

2. Related Art

There has been known a liquid ejecting apparatus which performs printing by using a liquid (e.g., UV ink) which is cured by irradiation of electromagnetic waves (e.g., ultraviolet rays). Such a liquid ejecting apparatus irradiates electromagnetic waves on dots formed on a medium after a liquid is ejected on the medium from a nozzle. In this way, since the dots are cured and fixed on the medium, appropriate printing can be performed with respect to the medium which there are difficulties in the absorption of the liquid (e.g., see JPA-2000-158793).

When dots are formed by the UV ink, it is possible to prevent mixing of the ink and other and other ink by irradiating the electromagnetic wave on the ink immediately after dot formation. When the ink is cured prior to the spreading of the dots after the ink lands on the medium, there is a problem in that since the area of the dots is decreased, the print concentration is lowered, or since the irregularity of a medium surface formed by the dots is increased, the gloss of an image is deteriorated.

Meanwhile, when the dots are sufficiently spread and then are irradiated by the electromagnetic wave after the ink lands on the medium, there may be mixing of the ink and other ink, although the concentration of the ink and the gloss of the image can be obtained.

As such, in the case of using the ink which is cured by irradiation of the electromagnetic waves, it is possible to suppress the mixing of the ink and obtain the gloss and concentration of the image, but there is still a problem in obtaining a good quality of the image.

SUMMARY

An advantage of some aspects of the invention is to obtain a good quality image in the case of using ink which is cured by irradiation of electromagnetic waves.

According to an aspect of the invention, there is provided a liquid ejecting apparatus including (A) a carriage that moves a nozzle ejecting a liquid which is cured by irradiation of electromagnetic waves in a moving direction, (B) a first irradiation section that is installed on the carriage and irradiates the electromagnetic waves on dots formed by landing the liquid which is ejected from the moving nozzle, on a medium, and (C) a second irradiation section that is installed on the carriage and irradiates the electromagnetic wave on the dots which are irradiated by the electromagnetic wave from the first irradiation section, in which an irradiance level of the electromagnetic waves from the second irradiation section is different from that of the electromagnetic waves from the first irradiation section.

Other characteristics of the invention will be apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Summary of Disclosure

Figure 1:
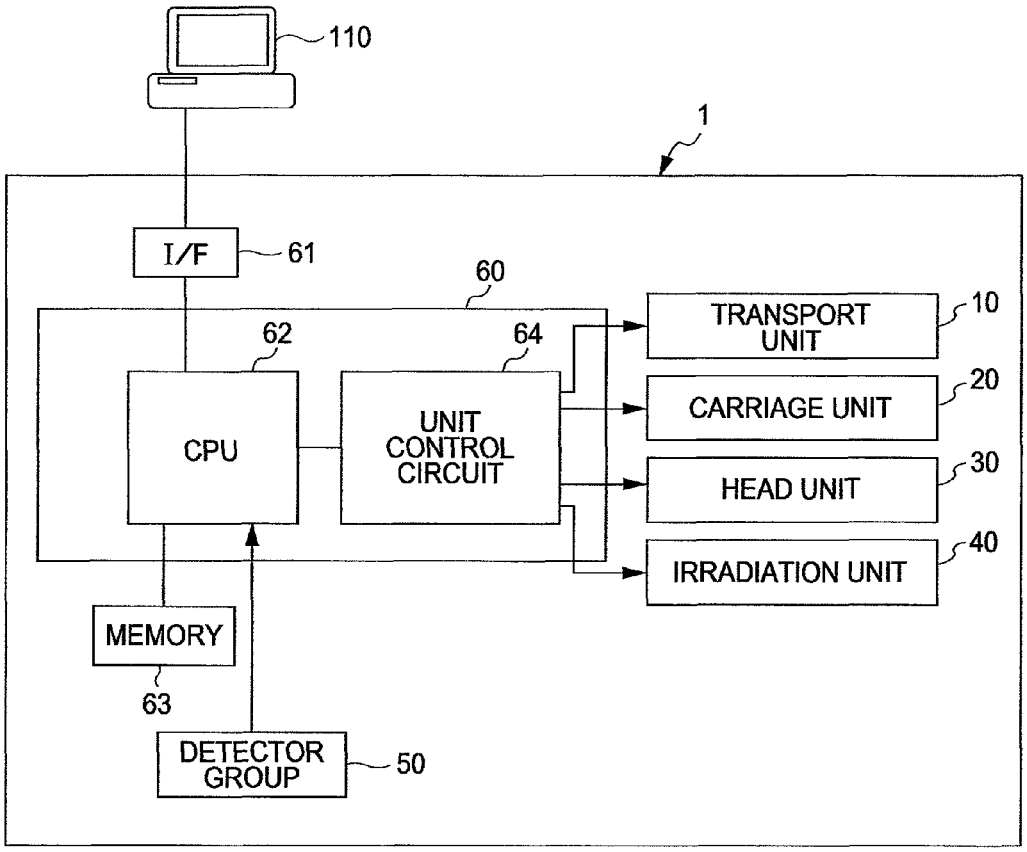
FIG. 1 is a block diagram showing the configuration of a printer.

The following points will be apparent from at least the specification and the accompanying drawings.

A liquid ejecting apparatus becomes apparent, the liquid ejecting apparatus including (A) a carriage that moves a nozzle ejecting a liquid which is cured by irradiation of electromagnetic waves in a moving direction, (B) a first irradiation section that is installed on the carriage and irradiates the electromagnetic waves on dots formed by landing the liquid, which is ejected from the moving nozzle, on a medium, and (C) a second irradiation section that is installed on the carriage and irradiates the electromagnetic waves on the dots which are irradiated by the electromagnetic wave from the first irradiation section, in which an irradiance level of the electromagnetic waves from the second irradiation section is different from that of the electromagnetic waves from the first irradiation section.

With the liquid ejecting apparatus, a good quality image can be obtained in the case of using the ink which is cured by the irradiation of the electromagnetic waves.

In the liquid ejecting apparatus, it is preferable that the irradiance level of the second irradiation section is higher than that of the first irradiation section.

With the liquid ejecting apparatus, suppression of mixing and the gloss are compatible.

In the liquid ejecting apparatus, by irradiating the electromagnetic waves from the second irradiation section, it is preferable to suppress the diameter of the dots from being enlarged after the electromagnetic waves are irradiated from the first irradiation section.

With the liquid ejecting apparatus, it is possible to easily control the diameter of the dots.

In the liquid ejecting apparatus, the medium is transported in a transport direction intersecting with the moving direction while the nozzle reciprocates in the moving direction, and the second irradiation section may be installed farther on a downstream side in the transport direction than a liquid landing region in which the liquid lands on the liquid.

With the liquid ejecting apparatus, it is possible to guarantee the time until the electromagnetic waves are irradiated on the dots from the second irradiation section.

In the liquid ejecting apparatus, it is preferable that the first irradiation section and the second irradiation section are configured in such a way that the irradiance level of the electromagnetic waves irradiated from any irradiation section is different from each other at an upstream side region and a downstream side region in the transport direction.

With the liquid ejecting apparatus, reduction in power consumption can be achieved.

In the liquid ejecting apparatus, a region of the irradiation section, in which the electromagnetic waves are not irradiated, may exist between the first irradiation section and the second irradiation section.

With the liquid ejecting apparatus, it is possible to guarantee the time until the electromagnetic waves are irradiated on the dots from the second irradiation section. In this way, it can control the diameter of the dot.

In the liquid ejecting apparatus, the second irradiation section may be installed at a position in parallel with the moving direction of the first irradiation section and the nozzle.

With the liquid ejecting apparatus, the electromagnetic waves are irradiated from the second irradiation section after the irradiation of the electromagnetic waves from the first irradiation section. Consequently, it is effective against the case in which the spreading of the dots is not intended.

In the following embodiments, an ink jet printer (hereinafter, referred to as a printer 1) will now be described as an example of the liquid ejecting apparatus.

First Embodiment

As to the Configuration of a Printer

Figure 2:
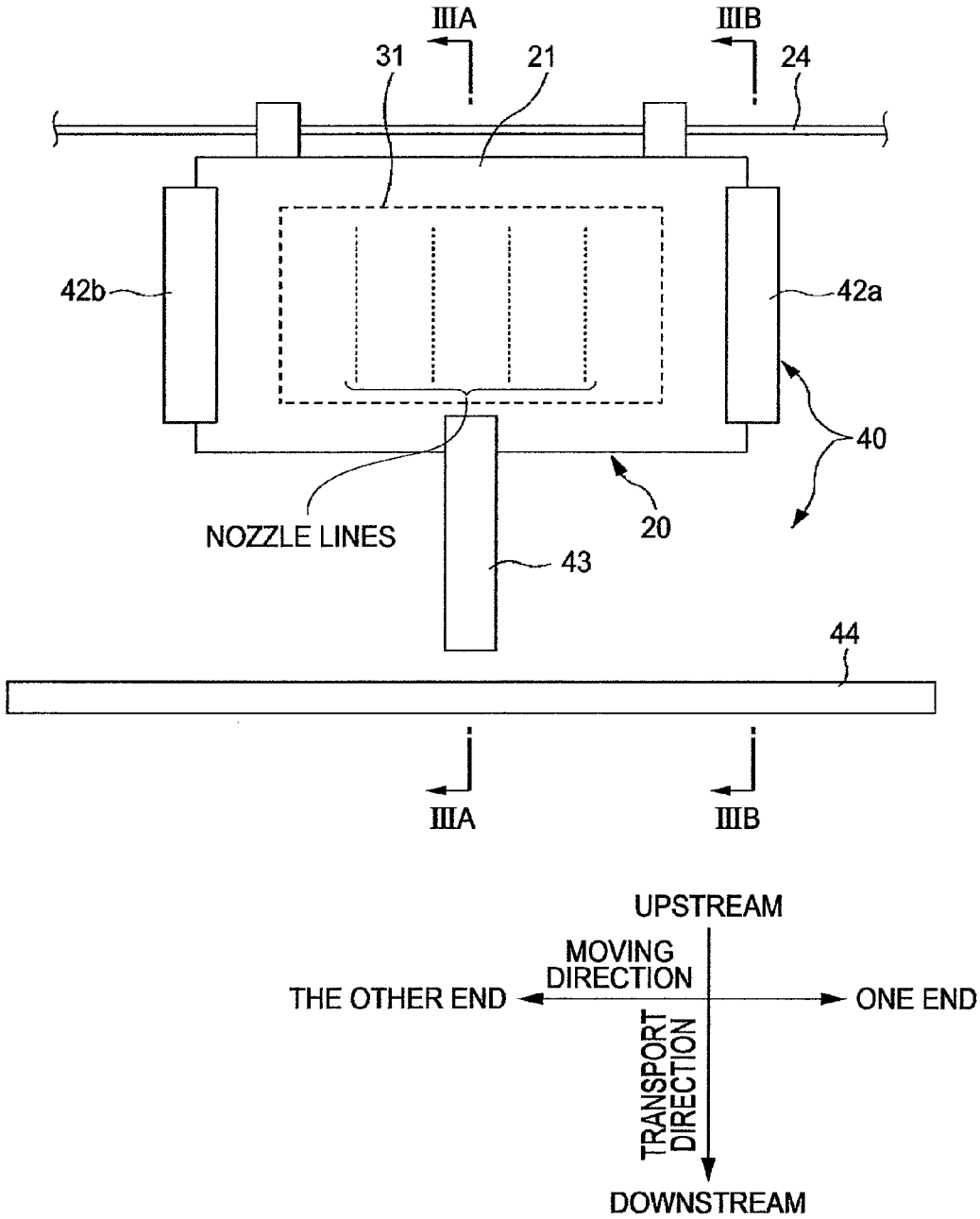
FIG. 2 is a perspective view of a periphery head of the printer.
Figure 3A:
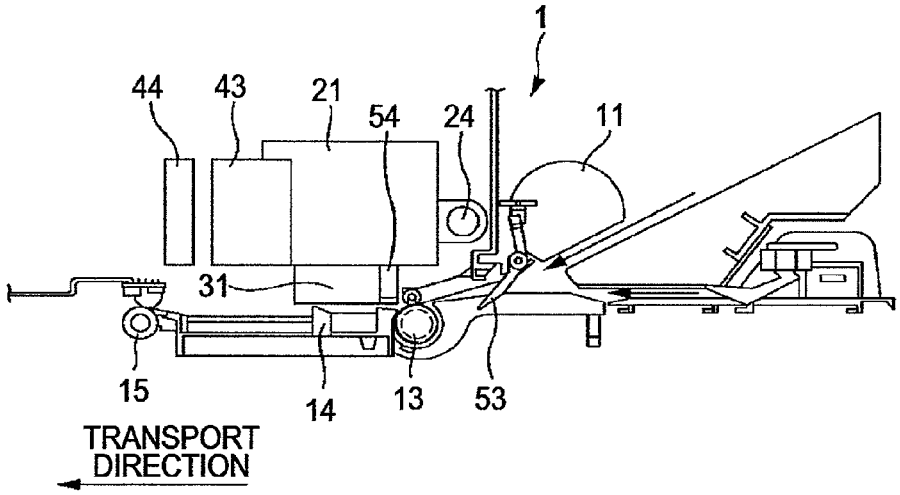
FIGS. 3A and 3B are cross-sectional views of the printer.
Figure 3B:
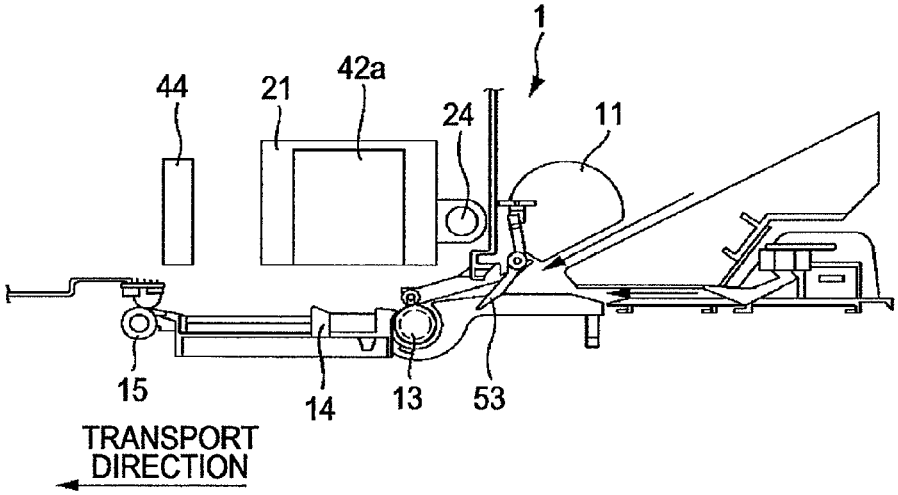

A printer 1 according to the first embodiment will now be described with reference to FIGS. 1, 2, 3A and 3B. FIG. 1 is a block diagram showing the configuration of the printer 1. FIG. 2 is a perspective view of a head periphery of the printer 1. FIGS. 3A and 3B are cross-sectional views of the printer 1. FIG. 3A corresponds to a cross section IIIA-IIIA of FIG. 2, and FIG. 3B corresponds to a cross section IIIB-IIIB of FIG. 2.

The printer 1 according to the invention is an apparatus for printing an image on a medium by ejecting ultraviolet curable ink (hereinafter, referred to as UV ink) towards a medium, such as paper, fabric or film sheets, to print an image on the medium, the UV ink being an example of a liquid and is cured by the irradiation of ultraviolet rays (hereinafter, referred to as UV). The UV ink is ink containing an ultraviolet curable resin and is cured by photo-polymerization reaction of the ultraviolet rays when the UV ink is irradiated by UV. In this instance, the printer 1 according to the embodiment prints the image by using the UV ink of four colors such as C, M, Y and K.

The printer 1 includes a transport unit 10, a carriage unit 20, a head unit 30, an irradiation unit 40, a detector group 50, and a controller 60. When the printer 1 receives print data from a computer 110 which is a peripheral device, the respective units (the transport unit 10, the carriage unit 20, the head unit 30 and the irradiation unit 40) are controlled by the controller 60. The controller 60 controls the respective units based on the print data received from the computer 110 and prints the image on the medium. The internal status of the printer 1 is monitored by the detector group 50, and the detector group 50 outputs the detected result to the controller 60. The controller 60 controls the respective units based on the detected result output from the detector group 50.

The transport unit 10 is configured to transport the medium (e.g., paper) in a predetermined direction (hereinafter, referred to as a transport direction). The transport unit 10 includes a paper feed roller 11, a transport motor (not shown), a transport roller 13, a platen 14, and a paper ejection roller 15. The paper feed roller 11 is a roller for feeding the medium inserted in a paper insertion opening to the printer. The transport roller 13 is a roller for transporting the medium fed by the paper feed roller 11 to a printable region, and is driven by the transport motor. The platen 14 supports the medium which is being printed on. The paper ejection roller 15 is a roller for ejecting the medium outwardly from the printer, and is installed at a downstream side of the printable region in the transport direction.

The carriage unit 20 is configured to move (otherwise referred to as "scan") the head in a predetermined direction (hereinafter, referred to as a moving direction). The carriage unit 20 includes a carriage 21 and a carriage motor (not shown). Also, the carriage 21 detachably holds an ink cartridge accommodating the UV ink therein. The carriage 21 is reciprocated along a guide shaft 24, which will be described below, by the carriage motor, with the carriage being supported by the guide shaft 24 intersecting with the transport direction.

The head unit 30 is configured to eject the liquid (the UV ink in this embodiment) on the medium. The head unit 30 has a head 31 with a plurality of nozzles. Since the head 31 is installed on the carriage 21, when the carriage 21 moves in the moving direction, the head 31 also moves in the moving direction. As the head 31 ejects the UV ink intermittently while moving in the moving direction, a dot line (i.e., a raster line) is formed on the medium along the moving direction. In this instance, a path, in which the head moves from one end side in FIG. 2 to the other end side, is hereinafter referred to as an outward stroke, while a path, in which the head moves from the other end side to the one end side, is hereinafter referred to as a returning stroke. In this embodiment, the UV ink is ejected during a period between the outward stroke and the returning stroke. That is, the printer 1 according to the embodiment performs bidirectional printing.

The configuration of the head 31 will be described below.

The irradiation unit 40 is configured to irradiate the UV on the UV ink which has landed on the medium. The dots formed on the medium are cured by irradiation of the UV from the irradiation unit 40. The irradiation unit 40 of the embodiment includes first temporary-curing irradiation units 42*a* and 42*b*, a second temporary-curing irradiation unit 43 and a permanent-curing irradiation unit 44. In this instance, the first temporary-curing irradiation units 42*a* and 42*b* correspond to the first irradiation section, and the second temporary-curing irradiation unit 43 corresponds to the second irradiation section. Also, the first temporary-curing irradiation units 42*a* and 42*b* and the second temporary-curing irradiation unit 43 are installed on the carriage 21.

The head 31 is interposed between the first temporary-curing irradiation units 42*a* and 42*b* which are respectively installed at one end side and the other end side of the head 31 in the moving direction. That is, the first temporary-curing irradiation units 42*a* and 42*b* are installed in parallel with the head 31 in the moving direction. Also, the length of the first temporary-curing irradiation units 42*a* and 42*b* in the transport direction is substantially equal to the distance of a nozzle line of the head 31. The first temporary-curing irradiation units 42*a* and 42*b* move together with the head 31 and irradiate the UV on the dots formed on the medium. The first temporary-curing irradiation units 42*a* and 42*b* have a light emitting diode (LED) as a light source of the UV irradiation. The LED can easily change irradiation energy by controlling the intensity of an input current.

The second temporary-curing irradiation unit 43 is installed farther on the downstream side in the transport direction than the head 31, at the center of the carriage 21 in the moving direction. That is, the second temporary-curing irradiation unit 43 is installed farther on the downstream side in the transport direction than the head 31 and the first temporary-curing irradiation units 42*a* and 42*b*. In other words, the second temporary-curing irradiation unit 43 is installed farther on the downstream side than the print region (corresponding to a liquid landing region) in which the ink lands on the medium to form the dots.

The length of the second temporary-curing irradiation unit 43 is substantially equal to that of the nozzle line of the head 31. The second temporary-curing irradiation unit 43 moves together with the head 31 at the time of movement of the head 31 to irradiate the UV on the dots formed on the medium. The second temporary-curing irradiation unit 43 of the embodiment has an LED as the light source of the UV irradiation.

The permanent-curing irradiation unit 44 is installed farther on the downstream side in the transport direction than the carriage 21. That is, the permanent-curing irradiation unit 44 is installed farther on the downstream side in the transport direction than the first temporary-curing irradiation units 42*a* and 42*b* and the second temporary-curing irradiation unit 43. Also, the length of the permanent-curing irradiation unit 44 in the moving direction is longer than the width of the printing medium. The permanent-curing irradiation unit 44 irradiates the UV towards the medium transported under the permanent-curing irradiation unit 44 by the transport operation and cures the dots on the medium (i.e., the permanent curing described below). The permanent-curing irradiation unit 44 of the embodiment has a lamp (e.g., metal halide lamp, mercury lamp or the like) as the light source of the UV irradiation.

The first temporary curing, the second temporary curing and the permanent curing will be described below.

The detector group 50 includes a linear type encoder (not shown), a rotary type encoder (not shown), a paper detecting sensor 53, and an optical sensor 54. The linear type encoder detects the position of the carriage 21 in the moving direction. The rotary type encoder detects a rotation amount of the transport roller 13. The paper detecting sensor 53 detects the position of a front end of the feeding paper. The optical sensor 54 detects existence of the paper by using a light emitting portion and a light receiving portion which are installed on the carriage 21. The optical sensor 54 is moved by the carriage 21 to detect the position of the end of the paper and thus detect the width of the paper. Also, the optical sensor 54 can also detect the front end (an end on the downstream side in the transport direction and also referred to as an upper end) and the rear end (an end on the upstream side in the transport direction and also referred to as a lower end) of the paper, depending on the situation.

The controller 60 is a control unit (control section) that performs the controlling of the printer 1. The controller 60 includes an interface portion 61, a CPU 62, a memory 63, and a unit control circuit 64. The interface portion 61 performs transmission and reception of data between the printer 1 and the computer 110 which is the peripheral device. The CPU 62 is an operation processing device for performing the controlling of the entire printer 1. The memory 63 is to ensure a region for storing programs of the CPU 62 and an operation region, and has a memory element such as RAM or EEPROM. The CPU 62 controls the respective units through the unit control circuit 64 according to the programs stored in the memory 63.

When performing the printing, the controller 60 alternatively repeats a dot forming operation of ejecting the UV ink from the head 31 which moves in an outward stroke direction and a returning stroke direction, as described below, and a transport operation of transporting the paper in the transport direction, thereby printing the image made of a plurality of dots on the paper. In this instance, the dot forming operation is referred to as "a pass." Also, the $n^{th}$ round of the passes is referred to as an $n^{th}$ pass. In this instance, the first temporary curing and the second temporary curing are performed as described below.

As to the Configuration of the Head 31

Figure 4:
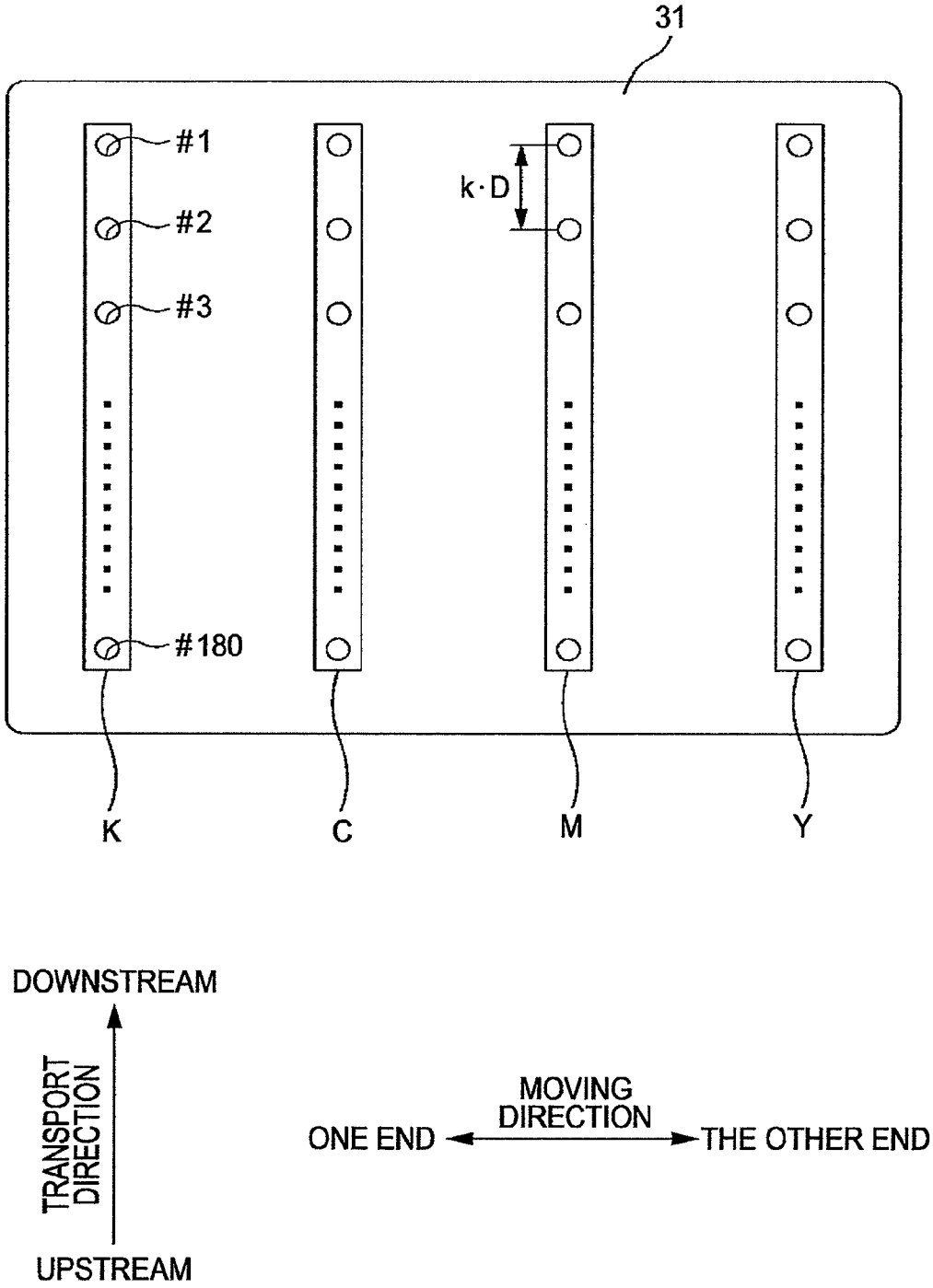
FIG. 4 is a view explaining the configuration of a head.

FIG. 4 is a view explaining an example of the configuration of the head 31. A black-ink nozzle group K, a cyan-ink nozzle line C, a magenta-ink nozzle line M, and a yellow-ink nozzle line Y are provided at a lower surface of the head 31, as shown in FIG. 4. Each of the nozzle lines has a plurality (180 in this embodiment) of nozzles which are ejection holes for ejecting the UV ink of each color.

The plurality of nozzles of the respective nozzle lines are arranged at a constant interval (nozzle pitch: k·D) in the transport direction. Here, D is a minimum dot pitch (i.e., an interval of the dots formed on the medium at the maximum resolution) in the transport direction. Also, k is an integral number more than 1. For example, when the nozzle pitch is 180 dpi (1/180 inch) and the dot pitch in the transport direction is 720 dpi (1/720 inch), k=4.

The nozzles of the respective nozzle lines are designated by numbers which are lowered as the nozzle is farther toward the downstream side in the transport direction. Each of the nozzles is provided with a piezoelectric element (not shown) as a driving element for ejecting the UV ink from the respective nozzles. The UV ink of a droplet shape is ejected from the respective nozzles by driving the piezoelectric element according to a driving signal. The ejected UV ink lands on the medium to form the dots.

As to the Temporary Curing and the Permanent Curing

Figure 5A:
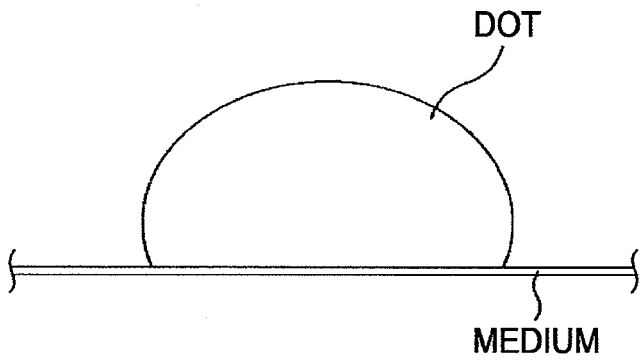
FIGS. 5A to 5C are views explaining the shape of UV ink (dot) which has landed on a medium and timing of UV irradiation.
Figure 5B:
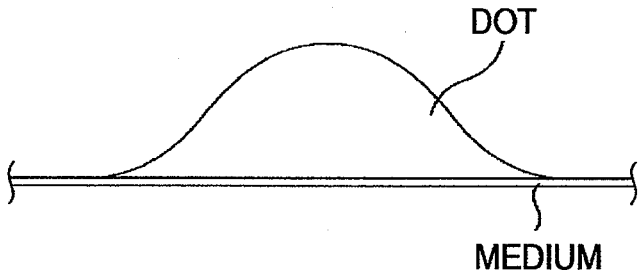
Figure 5C:
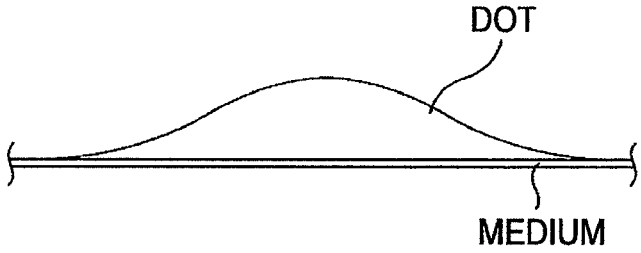

FIGS. 5A to 5C are views explaining the shape of UV ink (dot) which has landed on the medium and timing of UV irradiation. In this instance, the irradiation timing is delayed in the order of FIG. 5A, 5B and 5C.

In the case in which the UV is irradiated in order to stop the mixing the dots immediately after dot formation, for example, the dots are formed as shown in FIG. 5A. In this instance, although it can suppress the mixing, the irregularity of the medium surface is increased, and thus its gloss is deteriorated. And/or, since the area of the dots are reduced, the print concentration is deteriorated, and thus, it is necessary to use a lot of ink in order to obtain the image with a predetermined concentration.

Meanwhile, in the case in which the UV is first irradiated after the dots have sufficiently spread, for example, the dots are formed as FIG. 5C. In this instance, the gloss is good, and/or the print concentration is thickened. However, the mixing of the ink and other ink is likely to occur.

Consequently, the printer 1 of the embodiment includes the first temporary-curing irradiation units 42*a* and 42*b*, the second temporary-curing irradiation unit 43 and the permanent-curing irradiation unit 44 as the irradiation unit 40, and after the dot formation, performs three-step curing of the first temporary curing, the second temporary curing and the permanent curing. The function of the respective curing functions will now be described.

The function of the first temporary curing is to prevent the mixing of the dots. However, since the irradiance level of the UV irradiated on the dot at the time of first temporary curing is small, the UV ink (the dot) continues to spread after the first temporary curing.

The function of the second temporary curing is to stop the spreading of the dot. The irradiance level of the second temporary curing is higher than that of the first temporary curing. In this instance, the irradiance level ($mJ/cm^2$) is equal to a product of irradiation energy ($mW/cm^2$) and an irradiation time (sec).

In this embodiment, the input current of the LED of the respective irradiation sections is varied in order to change the irradiance levels of the first temporary curing and the second temporary curing. In this instance, it is not limited thereto, and, for example, the distance between the LED and the medium may be varied. Also, for example, the irradiation time may be adjusted by varying the length of the LED in the moving direction.

The function of the permanent curing is to fully solidify the ink. The UV irradiance level in the permanent curing is higher than that of the UV in the first and second temporary curing. That is, there is a relationship such that the irradiance level of the first temporary curing<the irradiance level of the second temporary curing<the irradiance level of the permanent curing.

As described above, the temporary curing which is divided into two parts (the first temporary curing and the second temporary curing) is performed in this embodiment. The reason is described below.

For example, one temporary-curing irradiation unit irradiates a total irradiance level at one time which corresponds to the first temporary curing and the second temporary curing. In this instance, in the case in which the timing of the temporary curing is set, a dot size is determined by the size at the time of temporary curing (when the UV is irradiated from the temporary-curing irradiation unit). For this reason, in the case in which the timing of the temporary curing has been set, it is not possible to control the dot size. Also, even though the timing of the temporary curing can be controlled, the spread velocity of the dots is fast in the time of temporary curing. Therefore, it is difficult to control the dot size by using the irradiation timing.

As this embodiment, in the case in which two temporary-curing irradiation units (the first temporary-curing irradiation unit and the second temporary-curing irradiation unit) are installed, it is possible to prevent the mixing by the first temporary curing. After the first temporary curing, the dot continues to spread. However, the spread speed is slowed in comparison with the case in which the first temporary curing is not performed.

Next, the mixing of the dots is stopped by the second temporary curing in this embodiment. In the case in which the timing of the second temporary curing has been set, the irradiance level of the first temporary curing is controlled in order to achieve an intended dot size at the time of the second temporary curing. Consequently, the dot size can be controlled. Also, in the case in which the timing of the second temporary curing is changed, since the spread speed of the dots has been slowed by the first temporary curing, it is possible to achieve the intended dot size by controlling the timing of the second temporary curing.

Printing Operation of the First Embodiment

The printing operation of the first embodiment will now be described.

FIGS. 6A to 6D are views explaining an aspect of image formation according to a first embodiment.

Figure 6A:
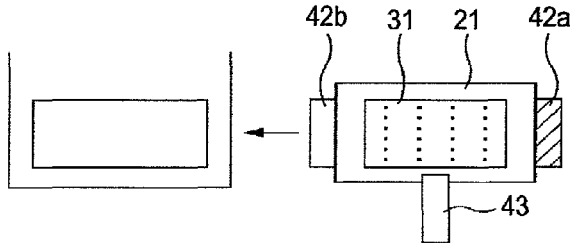
FIGS. 6A to 6D are views explaining an aspect of image formation according to a first embodiment.
Figure 6B:
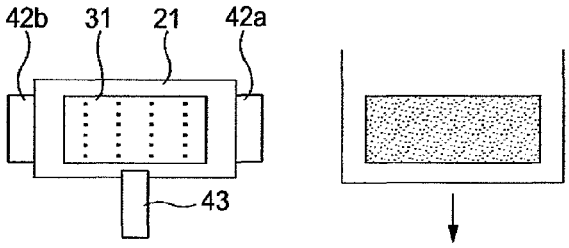
Figure 6C:
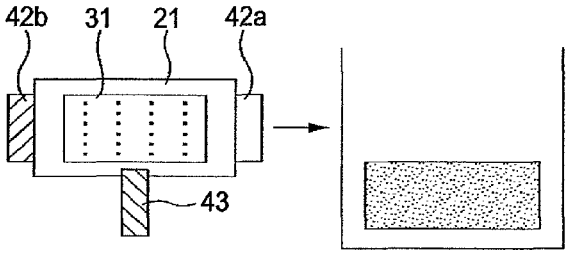
Figure 6D:
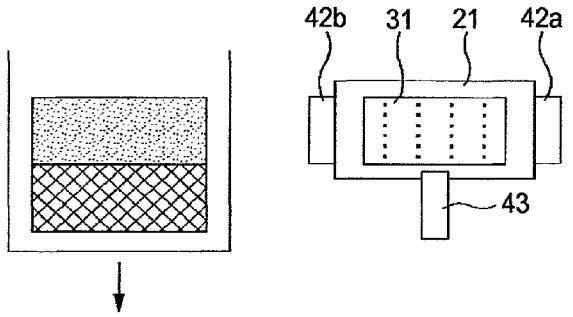
Figure 6D:
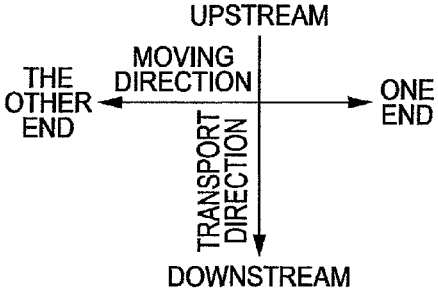

FIGS. 6A and 6B show the dot formation of the outward stroke, while FIGS. 6C and 6D show the dot formation of the returning stroke. In this instance, the portion (performing the UV irradiation) used in the first temporary-curing irradiation units 42*a* and 42*b* and the second temporary-curing irradiation unit 43 is indicated by a hatched line in each figure.

First, as shown in FIG. 6A, the controller 60 ejects the UV ink from the nozzle of the head 31 while the carriage 21 is moved in the moving direction (the outward stroke direction) in the initial pass (the outward stroke). Also, after the ink is ejected from the head 31, the controller 60 irradiates the UV from the first temporary-curing irradiation unit (in this instance, the first temporary-curing irradiation unit 42*a* indicated by the hatched line) at the upstream side in the moving direction of the head 31 to perform the first temporary curing. In this embodiment, since the first temporary-curing irradiation units 42*a* and 42*b* are installed at positions parallel with the moving direction of the head 31 of the carriage 21, the UV irradiation for the first temporary curing can be performed immediately after the dot formation. As the first temporary curing is performed immediately after the dot formation, it is possible to prevent the mixing of the dots from occurring.

Due to the pass of the outward stroke, the image is printed on the medium, as shown in FIG. 6B. In this instance, the printed image is maintained in the state (the state in which the mixing is suppressed, but the dots continue to spread) after the first temporary curing.

After the pass of the outward stroke, the controller 60 transports the medium a predetermined amount (the transport operation). A transport amount is substantially equal to the length of the nozzles in this embodiment, and thus, by the transport operation, as shown in FIG. 6, the image printed by the pass in FIG. 6B is positioned just adjacent to the downstream side of the print region, in which the image is printed by the pass in FIG. 6C, in the transport direction.

After the transport operation, the controller 60 performs the next pass (the returning stroke). The controller 60 moves the carriage 21 in the moving direction (the returning stroke direction), as shown in FIG. 6C, and ejects the UV ink from the nozzle of the head 31. Also, after the ink is ejected from the head 31, the controller 60 irradiates the UV from the first temporary-curing irradiation unit (in this instance, the first temporary-curing irradiation unit 42*b* indicated by the hatched line) at the upstream side in the moving direction of the head 31, thereby performing the first temporary curing. Since the moving direction in FIG. 6C is reverse to the case in FIG. 6A, the first temporary-curing irradiation unit for use in the first temporary curing is reverse to the case in FIG. 6A.

The image is printed on the medium by the pass, as shown in FIG. 6D, and immediately after the formation of the dots of the image, the first temporary curing is performed. In this instance, it is possible to prevent the mixing of the dots from occurring by performing the first temporary curing immediately after the formation of the dot.

Further, at the pass, the controller 60 irradiates the UV on the dots which are formed in the previous pass (the outward stroke) by the second temporary-curing irradiation unit 43 moving together with the head 31 in the moving direction. Since the second temporary-curing irradiation unit 43 is installed farther on the downstream side in the transport direction than the head 31 of the carriage 21, the second temporary-curing irradiation unit 43 can irradiate the UV on the dots formed in the previous pass. As such, in the first embodiment, the second temporary curing is performed at the pass next to the pass in which the dots are formed. It is possible to stop the spread of the dots in the state, in which the dots have been spread to some extent, by performing the second temporary curing at this timing. That is, the time for the dots to spread can be guaranteed. In this instance, since the first temporary curing is performed immediately after the formation of the dot, the spread speed of the dots has been slowed down, and thus the control of the spread is easily performed. When the second temporary curing is performed immediately after the formation of the dots, since the dots have not spread (see FIG. 5A), the irregularity of the medium surface formed by the dots is increased, and thus the gloss is deteriorated.

As such, the image of the print region shown in FIG. 6D after the pass of the returning stroke is maintained in the state (the state in which the mixing has been suppressed, but the dot continues to spread) after the first temporary curing, and the printed image at the downstream side of the print region in the transport direction is maintained in the state (the state in which the spread of the dots has been stopped) after the second temporary curing.

In the similar ways, the controller 60 alternatively performs the pass and the transport operation. Consequently, the image is printed on the medium.

Further, the controller 60 irradiates the UV on the dots formed on the medium by using the permanent-curing irradiation unit 44 at the time of continuous printing or paper ejection (the permanent curing). The reason is that, since the dots are fixed by the second temporary curing, the permanent curing can be performed at a spaced position.

As described above, according to the printer 1 of this embodiment, after the first temporary curing is performed at the low irradiance level by the first temporary-curing irradiation units 42*a* and 42*b*, the second temporary curing is performed at the irradiance level higher than the first temporary curing by the second temporary-curing irradiation unit 43. Consequently, it can achieve a balance between the suppressed mixing of the ink and the enhanced gloss and concentration of the image, thereby obtaining the good quality image.

In addition, since the second temporary-curing irradiation unit 43 is installed on the carriage 21 farther on the downstream side in the transport direction than the print region, the time until the second temporary curing is performed after the first temporary curing is performed can be guaranteed. Considering that the dots are slightly spread at that time, the irradiation conditions of the first temporary curing and the second temporary curing are set so that the dots are finally set to have an intended size at the second temporary curing.

Second Embodiment

As to the Configuration of a Printer

Figure 7:
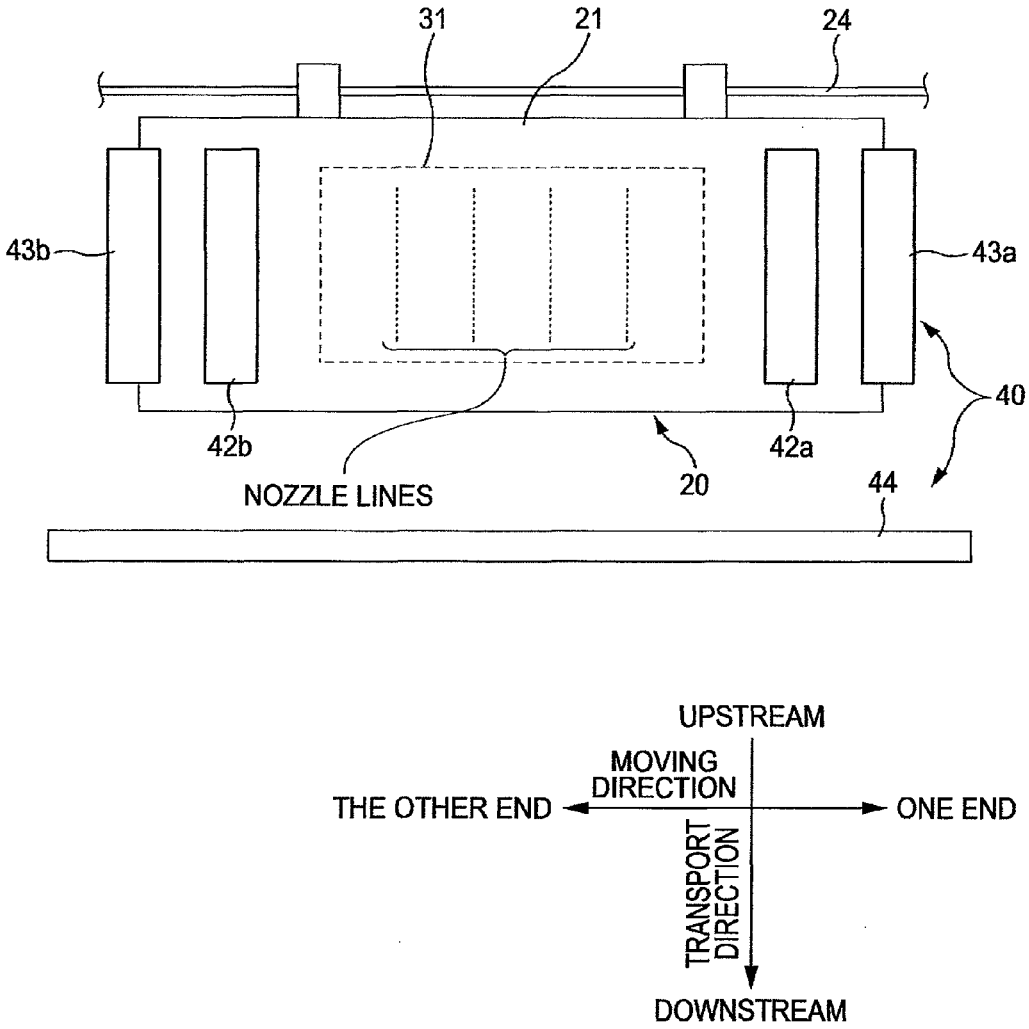
FIG. 7 is a view explaining a head portion according to a second embodiment.

FIG. 7 is a view explaining a head portion of the second embodiment. As compared with the first embodiment, the position of a second temporary-curing irradiation unit is different.

In the second embodiment, the carriage 21 is provided with first temporary-curing irradiation units 42*a* and 42*b* and second temporary-curing irradiation units 43*a* and 43*b*.

The first temporary-curing irradiation units 42*a* and 42*b* are installed at one end side and the other end side of the head 31 in the moving direction, similar to the first embodiment.

The second temporary-curing irradiation unit 43*a* is installed at a position (one end side in the moving direction) outside the first temporary-curing irradiation unit 42*a*. Also, the second temporary-curing irradiation unit 43*b* is installed at a position (the other end side in the moving direction) outside the first temporary-curing irradiation unit 42*b*. As such, the second temporary-curing irradiation units 43*a* and 43*b* are installed in parallel with the moving direction of the first temporary-curing irradiation units 42*a* and 42*b* and the head 31.

In this instance, the length of the nozzle line of the head 31, the first temporary-curing irradiation units 42*a* and 42*b*, and the second temporary-curing irradiation units 43*a* and 43*b* in the transport direction are substantially identical to each other.

In the second embodiment, the irradiance level of the UV from the second temporary-curing irradiation units 43*a* and 43*b* is higher than that of the UV from the first temporary-curing irradiation units 42*a* and 42*b*. The reason is that the function of the first temporary curing is different from that of the second temporary curing, as described in the first embodiment.

In this instance, the position of the second temporary-curing irradiation units 43*a* and 43*b* can be adjusted in the moving direction by a guide (not shown) on the carriage 21. In this way, the distance between the first temporary-curing irradiation unit 42*a* (42*b*) and the second temporary-curing irradiation unit 43*c* (43*d*) can be adjusted to control the timing of the second temporary curing. Consequently, the dot size can be adjusted.

Printing Operation of the Second Embodiment

The printing operation of the second embodiment will now be described.

FIGS. 8A to 8E are views explaining a dot forming operation of the second embodiment. In this embodiment, in the figures, only the formation of the dots in the outward stroke is shown.

Figure 8A:
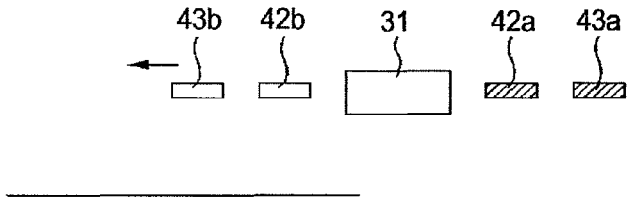
FIGS. 8A to 8E are views explaining the dot forming operation according to the second embodiment.

First, the controller 60 moves the carriage 21 in the moving direction (the outward stroke direction) at the pass of the outward stroke, as shown in FIG. 8A. In this instance, the used first temporary-curing irradiation unit and the used second temporary-curing irradiation units are indicated by a hatched line. As shown in the figures, the temporary-curing irradiation unit (the first temporary-curing irradiation unit 42*a* and the second temporary-curing irradiation unit 43*a*) at the upstream side in the moving direction of the head 31 are used.

Figure 8B:
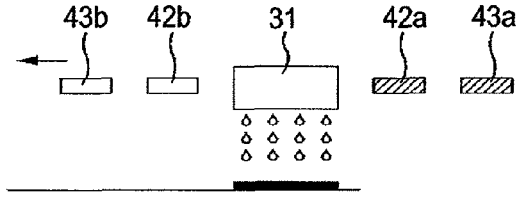

In FIG. 8B, the nozzle line of the head 31 is positioned above the medium. The controller 60 ejects the ink (the UV ink) from the respective nozzles of the head 31. Consequently, the UV ink lands on the medium to form the dot.

Figure 8C:
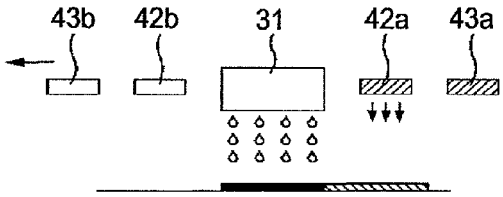

The controller 60 further moves the carriage 21 in the moving direction. Since the first temporary-curing irradiation unit 42*a* is positioned at the upstream side of the head 31 in the moving direction, the first temporary-curing irradiation unit 42*a* passes over the dots immediately after the formation in FIG. 8B, as shown in FIG. 8C. In this instance, the controller 60 irradiates the UV of the first temporary curing from the first temporary-curing irradiation unit 42*a*. As a result, the first temporary curing is performed at the timing immediately after the formation of the dot, thereby preventing the mixing of the dots immediately after the dots are formed on the medium.

Further, in FIG. 8B, the controller 60 ejects the UV ink from the nozzles of the head 31. Consequently, as shown in FIG. 8C, the region facing the head 31 is in the state immediately after the dots are formed (the permanent curing has not been performed), and the region facing the first temporary-curing irradiation unit 42*a* is in the state after the first temporary curing (the state in which the mixing is suppressed, but the dots continue to spread).

Figure 8D:
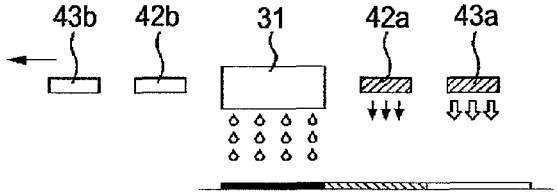

The controller 60 further moves the carriage 21 in the moving direction. Since the second temporary-curing irradiation unit 43*a* is positioned at the downstream side of the first temporary-curing irradiation unit 42*a* in the moving direction, the second temporary-curing irradiation unit 43*a* passes over the region which is subjected to the first temporary curing in FIG. 8C, as shown in FIG. 8D. In this instance, the controller 60 irradiates the UV of the second temporary curing from the second temporary-curing irradiation unit 43*a*. As will be understood from the above, the timing of the second temporary curing is determined by the distance between the first temporary-curing irradiation unit 42*a* and the second temporary-curing irradiation unit 43*a*. As a result, as described above, the position of the second temporary-curing irradiation unit 43*a* may be adjusted according to the timing. For example, as the distance between the first temporary-curing irradiation unit 42*a* and the second temporary-curing irradiation unit 43*a* becomes larger, the timing of the second temporary curing can be slowed, thereby making the spread of the dot large.

Further, in FIG. 8D, the controller 60 ejects the UV ink from the nozzles of the head 31, and irradiates the UV of the first temporary curing from the first temporary-curing irradiation unit 42*a*. Consequently, as shown in FIG. 8D, the region facing the head 31 is in the state immediately after the dots have been formed (the permanent curing has not been performed), and the region facing the first temporary-curing irradiation unit 42*a* is in the state after the first temporary curing (the state in which the mixing is suppressed, but the dots continue to spread). The region facing the second temporary-curing irradiation unit 43*a* is in the state after the second temporary curing (the state in which the spread of the dots has been stopped).

After that, in a similar way, the controller 60 moves the carriage 21, and simultaneously, ejects the UV ink from the nozzle line of the head 31. Also, the controller 60 performs the UV irradiation of the first temporary curing from the first temporary-curing irradiation unit 42*a*, and performs the UV irradiation of the second temporary curing from the second temporary-curing irradiation unit 43*a*.

Figure 8E:
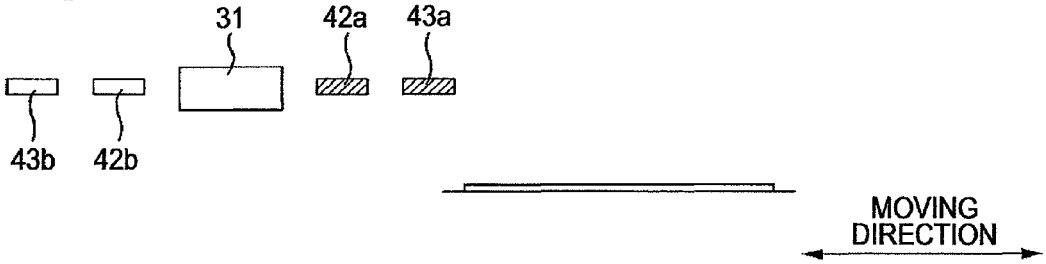

As shown in FIG. 8E, when the carriage 21 passes along the medium, the dots formed on the medium are in the state after the second temporary curing.

In the case of the returning stroke, the controller 60 performs the similar processing. In this instance, the moving direction in the returning stroke is different (the opposite) from the moving direction in the outward stroke. Consequently, in the returning stroke, the controller 60 performs the first temporary curing and the second temporary curing by using the first temporary-curing irradiation unit 42*b* and the second temporary-curing irradiation unit 43*b* which are positioned at the upstream side of the head 31 in the moving direction in the returning stroke.

As such, in the second embodiment, after the first temporary curing is performed by the first temporary-curing irradiation unit 42*a* (42*b*), the second temporary curing is performed by the second temporary-curing irradiation unit 43*a* (43*b*). Consequently, it can achieve a balance between the suppressing of the mixing of the ink and the enhanced gloss of the image.

In addition, in the second embodiment, the second temporary-curing irradiation units 43*a* and 43*b* are installed on the carriage 21 farther on the outside than the first temporary-curing irradiation units 42*a* and 42*b*, respectively. Consequently, at the time of the pass, the first temporary curing is performed, and then the second temporary curing is performed. That is, it is effective in the case in which the spreading of the dots is not intended. In this instance, the time (i.e., the spread of the dot) until the second temporary curing can be adjusted by varying the distance between the second temporary-curing irradiation units 43*a* and 43*b* and the first temporary-curing irradiation units 42*a* and 42*b*.

Third Embodiment

Figure 9:
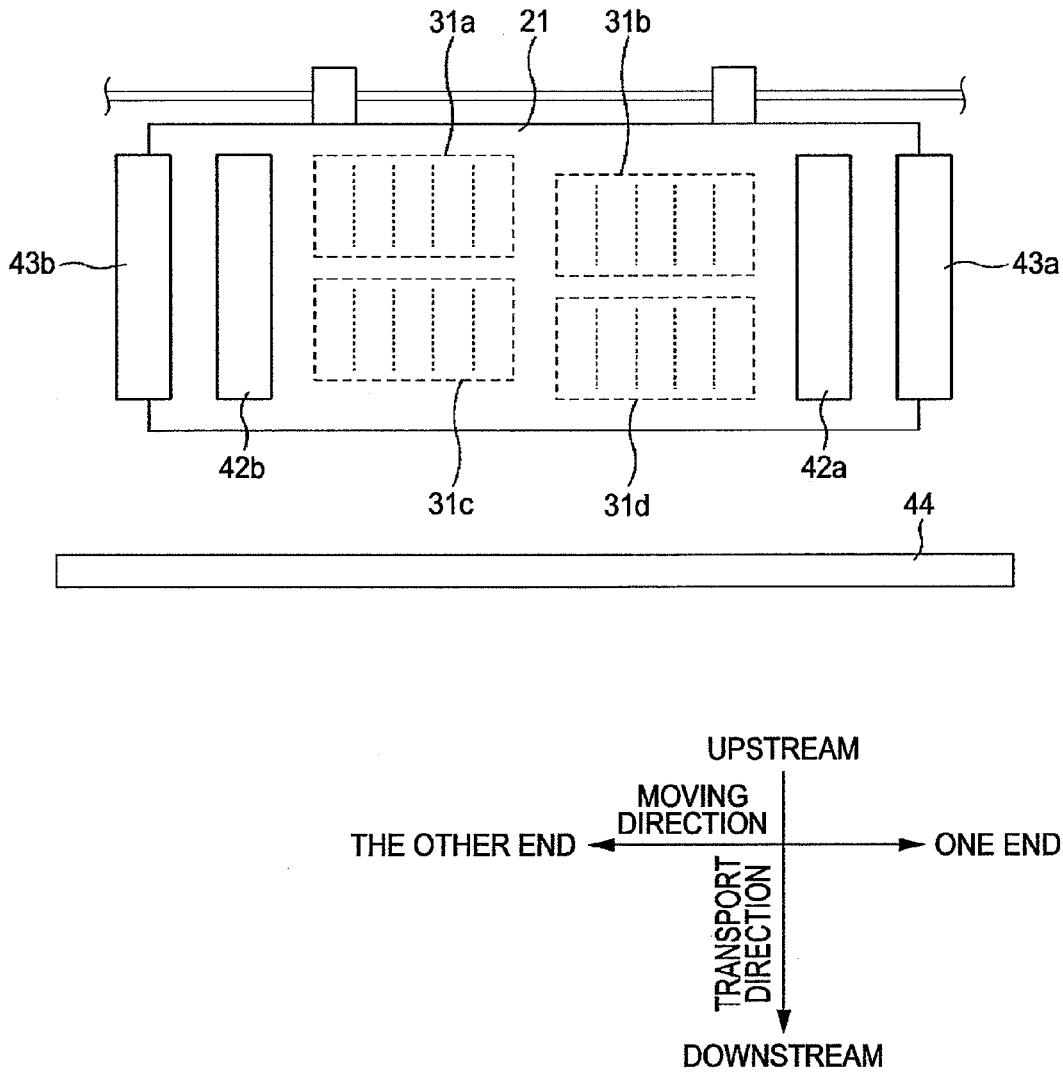
FIG. 9 is a view explaining a head portion according to a third embodiment.

FIG. 9 is a view explaining a head portion of the third embodiment. The configuration of the head in the third embodiment is different from that in the second embodiment.

In the third embodiment, a carriage 21 is provided with four heads (heads 31*a*, 31*b*, 31*c* and 31*d*). Also, similar to the second embodiment, the carriage 21 is provided with first temporary-curing irradiation units 42*a* and 42*b* and second temporary-curing irradiation units 43*a* and 43*b*.

The head 31*a* and the head 31*c* are disposed in parallel in a transport direction at the other end side in a moving direction. Also, the head 31*b* and the head 31*d* are disposed in parallel in the transport direction at one end side in the moving direction. Further, each of the heads is disposed so as to deviate in the transport direction.

The first temporary-curing irradiation units 42*a* and 42*b* are installed at the outside of the respective heads such that four heads are interposed between the first temporary-curing irradiation units 42*a* and 42*b*.

Meanwhile, the second temporary-curing irradiation units 43*a* and 43*b* are installed farther on the outside than the first temporary-curing irradiation units 42*a* and 42*b* respectively.

The distance of the first temporary-curing irradiation units 42*a* and 42*b* and the distance of the second temporary-curing irradiation units 43*a* and 43*b* in the transport direction are equal to the length of the nozzle line constituted by four heads.

In this instance, the printing operation (the dot formation and the UV irradiation) in the third embodiment is similar to that in the second embodiment, and its description will be omitted herein.

In the third embodiment, after the first temporary curing is performed by the first temporary-curing irradiation unit 42*a* (42*b*), the second temporary curing is performed by the second temporary-curing irradiation unit 43*a* (43*b*). Consequently, it can achieve a balance between the suppressing of the mixing of the ink and the enhanced gloss of the image.

Fourth Embodiment

As to the Configuration of a Printer

Figure 10:
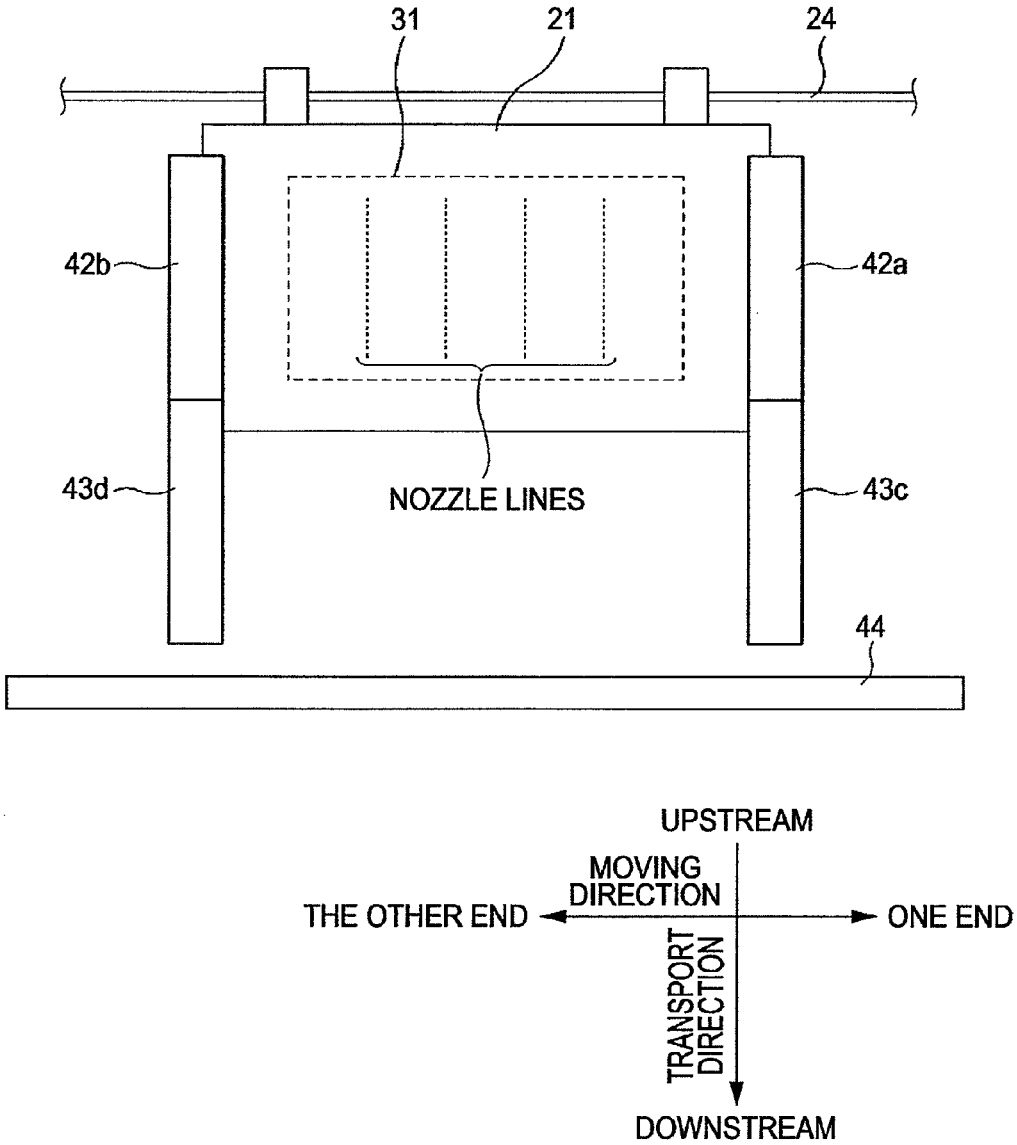
FIG. 10 is a view explaining a head portion according to a fourth embodiment.

FIG. 10 is a view explaining a head portion of the fourth embodiment. As compared with the first and second embodiments, the position and shape of a second temporary-curing irradiation unit are different.

As shown in FIG. 10, in the fourth embodiment, a carriage 21 is provided with second temporary-curing irradiation units 43*c* and 43*d* at downstream sides of the first temporary-curing irradiation units 42*a* and 42*b* in a transport direction, respectively.

The distance of the second temporary-curing irradiation units 43*c* and 43*d* in the transport direction is equal to that (the length of the nozzle line of the head 31) of the first temporary-curing irradiation units 42*a* and 42*b* in the transport direction. However, when the transport amount of the medium is previously determined, the distance may be equal to the transport amount. For example, when the transport amount is a quarter of the length of the nozzle line, the distance of the second temporary-curing irradiation units 43*c* and 43*d* may be also a quarter of the nozzle line.

In this instance, the irradiance level of UV from the second temporary-curing irradiation units 43*c* and 43*d* is higher than that of the UV from the first temporary-curing irradiation units 42*a* and 42*b*. The reason is that the first temporary curing has a different function from that of the second temporary curing.

Printing Operation of the Fourth Embodiment

Figure 11:
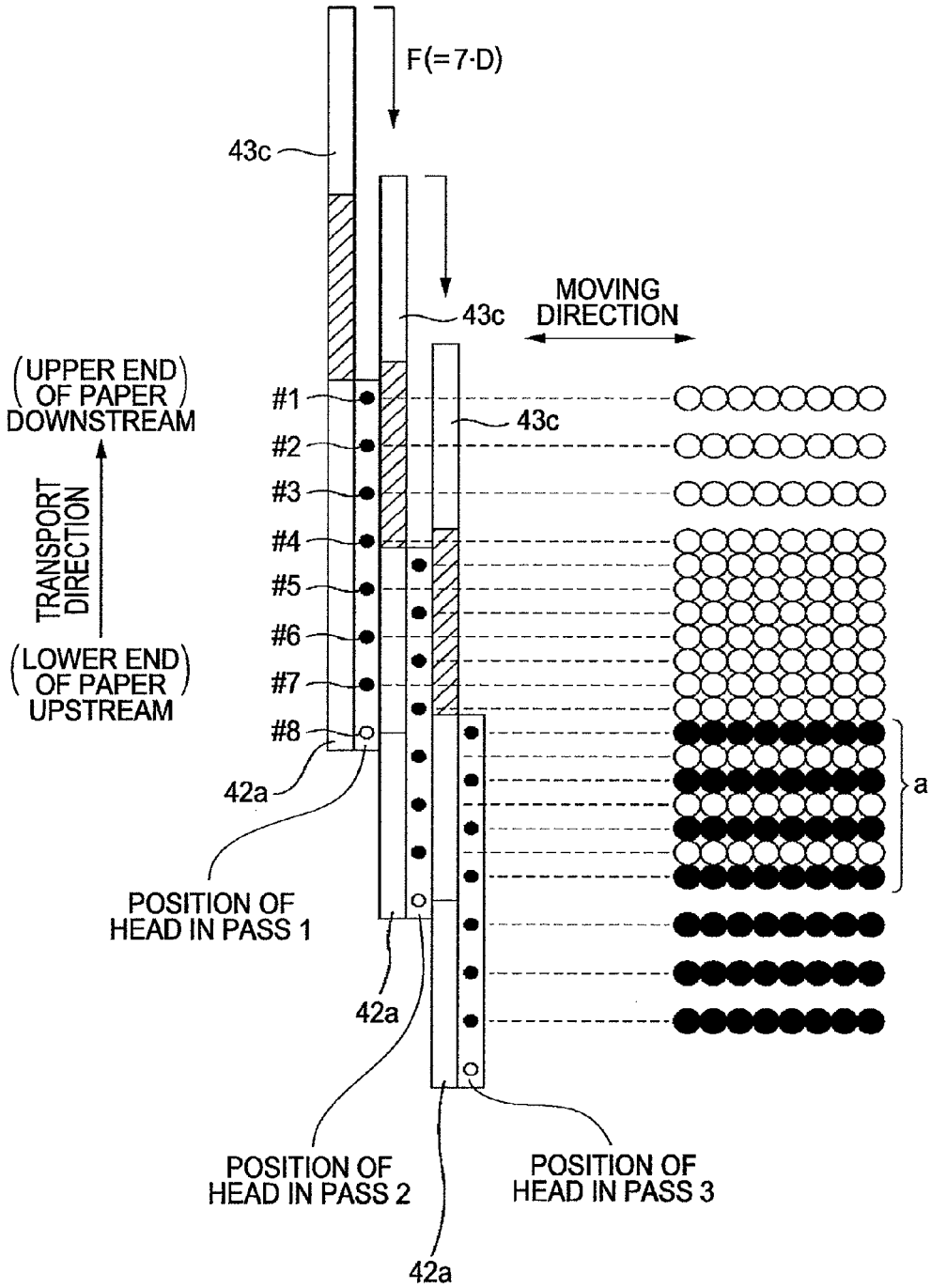
FIG. 11 is a view explaining a printing operation according to the fourth embodiment.

FIG. 11 is a view explaining the printing operation of the fourth embodiment. In the fourth embodiment, for descriptive convenience, the dot forming operation is performed not by bidirectional print, but only by the outward stroke. FIG. 11 shows the positions of the head (the nozzle line) in the first pass to the third pass, the first temporary-curing irradiation unit 42*a* and the second temporary-curing irradiation unit 43*c*, and the aspect of dot formation.

In this instance, for descriptive convenience, FIG. 11 shows only one nozzle line among the plurality of nozzle lines, and the number of the nozzles in the nozzle line is eight.

The left side of the figure shows the position of the head (the nozzle line) in the first pass to the third pass. In the figure, the nozzles indicated by block circles are nozzles which can eject ink. Meanwhile, the nozzle indicated by a white circle is a nozzle which cannot eject ink. Also, for descriptive convenience, although the figure shows that the head (the nozzle line) is moved with respect to the paper, the paper is actually moved (transported) in the transport direction.

Further, the right side of the figure shows the dot formed on the paper by the pass. The dots indicated by black circle are dots formed at the final pass, while the dots indicated by white circles are dots formed at the previous pass. That is, in the case of the figure, the white circle is the dots formed at the first pass or the second pass, the black circle is the dots formed at the third pass.

Interlacing printing is performed in this reference example. The term "interlacing printing" means a printing method in which k is 2 or more, a non-formed raster line is interposed between raster lines which are formed at one pass. For example, in FIG. 11, one raster line is interposed between raster lines which are formed at one pass. That is, k=2 in the case.

In the interlacing printing, whenever the paper is transported at a constant transport amount F in the transport direction, each of the nozzles forms the raster line immediately over the raster line formed at the previous pass. As such, in order to perform the printing with constant transport amount, there are conditions in which (1) the number N (integral number) of nozzles which can eject ink is in a prime relation with k, and (2) a transport amount F is set as N·D.

In the same figure, the nozzle line has 8 nozzles arranged in the transport direction. Since a nozzle pitch k of the nozzle line is 2, all of the nozzles are not used, and 7 nozzles (i.e., the first nozzle to the seventh nozzle) are used, in order to meet with the prime relation of N and k. Also, since 7 nozzles are used, the paper is transported at the transport amount of 7·D. As a result, the dots are formed on the paper at the dot interval of 360 dpi (=D) by using the nozzle line having the nozzle pitch of 180 dpi (2·D). In this instance, since the actual number (180) of nozzles is larger than 7, the actual transport amount (179·D) is larger than 7·D.

In the case of the interlacing printing, k passes are needed to complete the raster line having a continuous nozzle pitch width. For example, 2 passes are needed to complete two raster lines having continuous dot interval of 360 dpi by using the nozzle line having the nozzle pitch of 180 dpi.

As described below, in FIG. 11, the hatched portion of the second temporary-curing irradiation unit 43*c* indicates a region in which an LED is turned on, and the non-hatched portion indicates a region in which an LED is turned off.

FIGS. 12A to 12E are views explaining circumstances of the dot formation and the UV irradiation in the region a in FIG. 11.

Figure 12A:
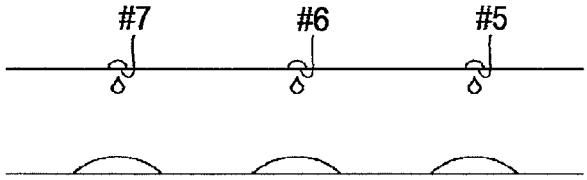
FIGS. 12A to 12E are views explaining circumstances of dot formation and UV irradiation in the region a of FIG. 11.
Figure 12B:
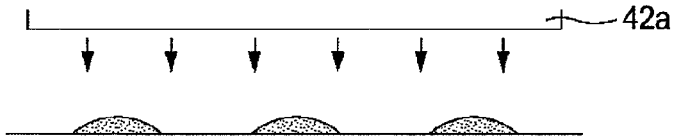
Figure 12C:
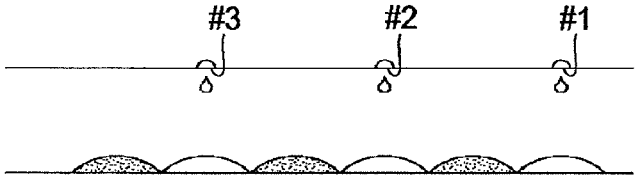
Figure 12D:
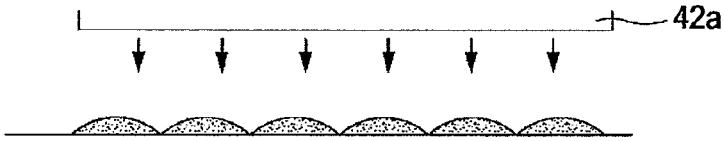
Figure 12E:
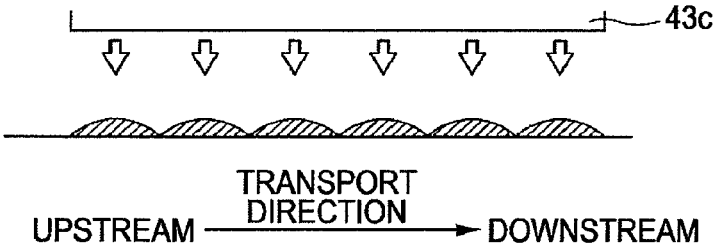

FIG. 12A is a view showing the dot forming operation (the second pass) of the region a. FIG. 12B is a view showing the temporary curing (the first temporary curing) at the second pass. FIG. 12C is a view showing the dot forming operation (the third pass) of the region a. FIG. 12D is a view showing the temporary curing (the first temporary curing) at the third pass. FIG. 12E is a view showing the temporary curing (the second temporary curing) at the fourth pass.

First, as shown in FIG. 12A, the region a at the second pass faces the nozzle (i.e., the fifth nozzle to the seventh nozzle) at the upstream side of the head 31. The UV ink is ejected from the respective nozzles to form the dots on the medium.

After that, as the carriage 21 (the head 31) is moved in the moving direction, as shown in FIG. 12B, the first temporary-curing irradiation unit 42*a* positioned at the position in parallel with the upstream side nozzle (the fifth nozzle to the seventh nozzle) in the moving direction passes over the region a. In this instance, the controller 60 irradiates the UV towards the medium from the first temporary-curing irradiation unit 42*a*. In this way, the first temporary curing of the dot formed by the upstream side nozzle is performed. According to the temporary curing, the mixing of the dots is suppressed, but the dots continue to spread. However, the spread speed is slowed.

After that, the transport operation is performed, and the region a faces the downstream side nozzle (the first nozzle to the fourth nozzle) in the nozzle line at the next path (the third pass), as shown in FIG. 12C. The UV ink is ejected from the respective nozzles to form the dots. In this instance, the dots are formed between the dots formed at the second pass. For example, the dots are formed by the third nozzle at the third pass between the dots formed by the seventh nozzle and the dots formed by the sixth nozzle at the second pass. That is, in the region a, there are mixed with the dots (the dots which are not temporarily cured) immediately after the formation and the dots which are subjected to once temporary curing (the first temporary curing).

After that, as the carriage 21 (the head 31) is moved in the moving direction, at the next pass (the fourth pass), the first temporary-curing irradiation unit 42*a* positioned at the position in parallel with the downstream side nozzle (the first nozzle to the fourth nozzle) in the moving direction passes over the region a. In this instance, the controller 60 irradiates the UV towards the medium from the first temporary-curing irradiation unit 42*a*. In this way, the dots of the region a immediately after the formation and the dots (dots formed at the second pass) which are subjected to the first temporary curing are irradiated by the UV to be subjected to the first temporary curing. That is, in this instance, the mixing of the dots is suppressed, but the dots continue to spread.

Next, the transport operation is performed, and the region of the upstream side of the second temporary-curing irradiation unit 43*c* passes over the region a at the next pass (pass 4). The controller 60 turns on the LED at the region (the hatched portion in the figure) of the upstream side of the second temporary-curing irradiation unit 43*c* in the transport direction. In this way, the dots of the region a are subjected to the second temporary curing. The spread of the dots is stopped by the second temporary curing. That is, the dot shape is fixed. Also, in this instance, the controller turns off the LED at the region (the non-hatched portion in FIG. 11) of the downstream side of the second temporary-curing irradiation unit 43*c*. Consequently, a reduction in power consumption can be promoted.

In this instance, although the half of the second temporary-curing irradiation unit 43*c* is turned on in this embodiment, an LED lighting range of the second temporary-curing irradiation unit 43*c* can be varied according to the transport amount. For example, in the case in which the transport amount is a quarter of the length of the nozzle line, a quarter range of the LEDs at the upstream side of the second temporary-curing irradiation unit 43*c* in the transport direction may be turned on. In this way, a reduction in power consumption can be further achieved.

In this embodiment, the LED lighting region of the second temporary-curing irradiation unit 43*c* is at the upstream side in the transport direction. That is, the LED lighting region of the second temporary-curing irradiation unit is adjacent to the first temporary-curing irradiation unit 42*a*. Consequently, the time interval between the first temporary curing and the second temporary curing is shortened.

Accordingly, the LED lighting region of the second temporary-curing irradiation unit 43*c* may be set at the downstream side in the transport direction, with an LED light-off region having a length corresponding to the transport amount or an integral multiple of the transport amount being interposed between the LED lighting region. In this way, there is a longer time interval until the second temporary curing is performed after the first temporary curing. For example, in this case, the time for one or several times of the passes and the transport operation is lengthened. That is, since the spread time of the dots is lengthened, the dots are enlarged. It is possible to control the spread time of the dot by setting the LED lighting region of the second temporary-curing irradiation unit 43*c*, and thus the dot size can be controlled.

In this instance, in this embodiment, the dots immediately after the formation are mixed with the dots which are subjected to one first temporary curing in FIG. 12D. These dots are irradiated by the UV of the first temporary curing from the downstream side of the first temporary-curing irradiation unit 42*a* in the transport direction to perform the first temporary curing. That is, in this embodiment, the difference in the UV irradiance level of the first temporary curing with respect to the respective dots in the region a is double. Accordingly, the UV irradiance level (corresponding to the irradiance level in FIG. 12D) at the downstream side of the first temporary-curing irradiation unit 42*a* in the transport direction may be set to be higher than the UV irradiance level (corresponding to the irradiance level in FIG. 12B) at the upstream side in the transport direction. In this way, the difference in the UV irradiance level of the first temporary curing which is applied to the respective dots can be minimized, thereby forming the shape of the dots more uniformly.

As such, in the fourth embodiment, after the first temporary curing is performed by the first temporary-curing irradiation unit 42*a* (42*b*), the second temporary curing is performed by the second temporary-curing irradiation unit 43*c* (43*d*). Consequently, it can achieve a balance between the suppressing of the mixing of the ink and the enhanced gloss of the image.

Further, the second temporary-curing irradiation units 43*c* and 43*d* are installed farther on the downstream side in the transport direction than the printing region. Consequently, the time until the second temporary curing is performed can be guaranteed.

In addition, since the LEDs at the upstream side region of the second temporary-curing irradiation unit 43*c* in the transport direction are turned on, and the LEDs at the downstream side region in the transport direction are turned off, a reduction in power consumption can be promoted. Also, since the lighting region of the second temporary-curing irradiation unit 43*c* is set at the downstream side in the transport direction, the time until the second temporary curing can be guaranteed is further lengthened.

In this instance, one of the second temporary-curing irradiation units 43*c* and 43*d* may be turned on to be used at the second temporary curing, or both units may be turned on to perform the second temporary curing in both second temporary-curing irradiation units 43*c* and 43*d*.

In the above-described embodiment, as shown in FIG. 11, the raster line between raster lines of a nozzle pitch interval formed at one pass is set as the transport amount shorter than the length of the nozzle line in the transport direction in order to form the dots at other pass. However, instead of this or in addition to this, one raster line may be formed from at plural passes. In this case, the transport amount is shorter than the length of the nozzle line.

Fifth Embodiment

As to the Configuration of a Printer

Figure 13:
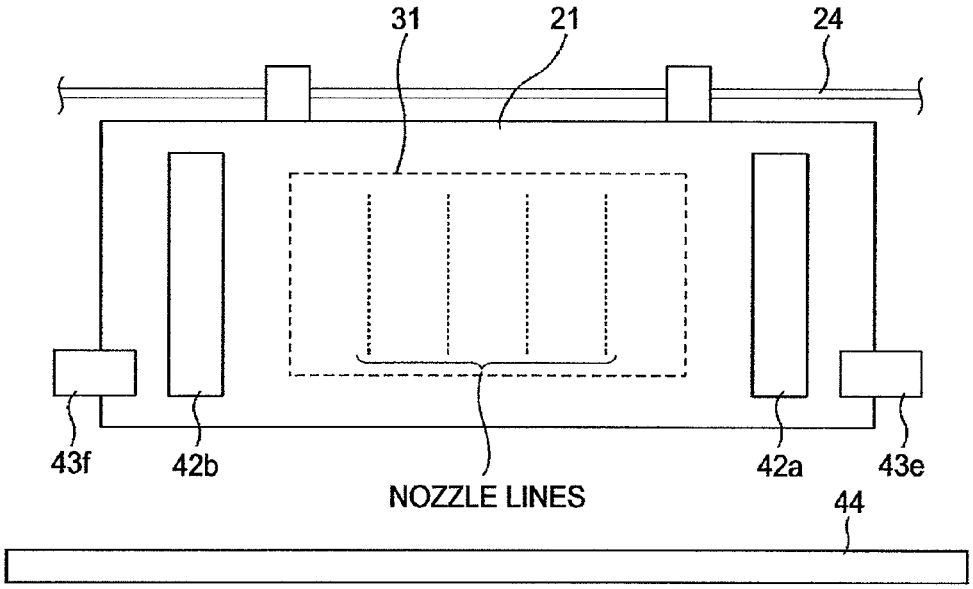
FIG. 13 is a view explaining a head portion according to a fifth embodiment.
Figure 13:
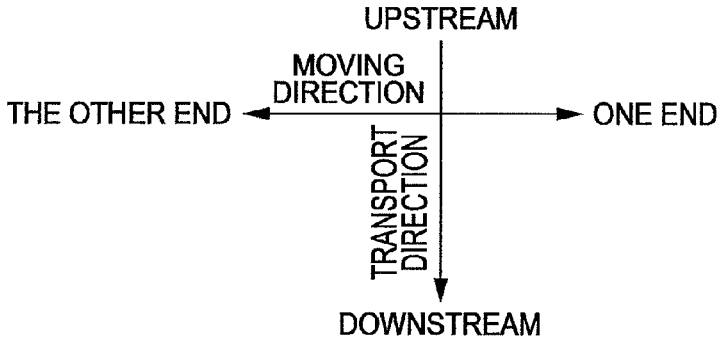

FIG. 13 is a view explaining a head portion of the fifth embodiment. As compared with the second embodiment, the shape of a second temporary-curing irradiation unit are different. Further, as compared with the fourth embodiment, the position and shape of a second temporary-curing irradiation unit are different.

As shown in FIG. 13, in the fifth embodiment, a carriage 21 is provided with second temporary-curing irradiation units 43*e* and 43*f* at upstream sides of the first temporary-curing irradiation units 42*a* and 42*b* in the transport direction, respectively.

The distance of the second temporary-curing irradiation units 43*e* and 43*f* in the transport direction is shorter than that of the first temporary-curing irradiation units 42*a* and 42*b* in the transport direction, and corresponds to a transport amount of a medium. For example, when the transport amount is set as a quarter of the length of a nozzle line, the distance of the second temporary-curing irradiation units 43*e* and 43*f* in the transport direction is a quarter of the nozzle line. However, the second temporary-curing irradiation units 43*a* and 43*b* may be constituted as the second embodiment, and may be set as a lighting region according to the transport amount, as shown in FIG. 13.

Further, the irradiance level of UV from the second temporary-curing irradiation units 43*e* and 43*f* is higher than that of the UV from the first temporary-curing irradiation units 42*a* and 42*b*. The reason is that the first temporary curing has a different function from that of the second temporary curing.

Similar to the second embodiment, the second temporary-curing irradiation units 43*e* and 43*f* can be positioned in the moving direction by a guide (not shown) on the carriage 21. In this way, the distance between the head 31, the first temporary-curing irradiation unit 42*a* (42*b*) and the second temporary-curing irradiation unit 43*e* (43*f*) can be adjusted, thereby controlling the timing of the second temporary curing. Consequently, dot size can be adjusted.

Printing Operation of the Fifth Embodiment

The dot formation and UV irradiation of the fifth embodiment are substantially equal to those of FIG. 12 of the fourth embodiment. However, in the fifth embodiment, the temporary curing in FIG. 12E is immediately after the dot formation in FIG. 12C and the first temporary curing in FIG. 12D (the passes are equal to that of the dot formation in FIG. 12C and the first temporary curing in FIG. 12D).

In the fifth embodiment, the timing of the second temporary curing is determined by the distance between the first temporary-curing irradiation unit and the second temporary-curing irradiation unit, similar to the second embodiment. For this reason, the position of the second temporary-curing irradiation unit 43*a* may be adjusted depending upon the timing.

Further, the position of the second temporary-curing irradiation units 43*e* and 43*f* in the transport direction may be varied. For example, as the second temporary-curing irradiation units 43*e* and 43*f* are installed at the downstream side in the transport direction, the time until the second temporary curing can be lengthened.

As such, in the fifth embodiment, after the first temporary curing is performed by the first temporary-curing irradiation unit 42*a* (42*b*), the second temporary curing is performed by the second temporary-curing irradiation unit 43*e* (43*f*). Consequently, it can achieve a balance between the suppressing of the mixing of the ink and the enhanced gloss of the image.

In addition, in the fifth embodiment, the second temporary-curing irradiation units 43*e* and 43*f* are installed on the carriage 21 farther on the outside than the first temporary-curing irradiation units 42*a* and 42*b*, respectively. Consequently, at the time of the pass, the first temporary curing is performed, and then the second temporary curing is performed. Also, the time until the second temporary curing can be adjusted by varying the distance between the second temporary-curing irradiation unit 43*e* (43*f*) and the first temporary-curing irradiation unit 42*a* (42*b*). That is, the spread of the dots can be adjusted.

Other Embodiments

While the printer is described as one embodiment, the above embodiments is intended not to definitively interpret the invention but to easily understand it. It is apparent to those skilled in the art that the invention can be modified and varied, without deviating from its teachings, and includes its equivalent. In particular, embodiments described below are contained in the invention.

In the respective embodiments, the length of the second temporary-curing irradiation unit 43 in the transport direction is equal to the length of the transport amount, but the length of the second temporary-curing irradiation unit 43 can be set to be any integral multiple of the length of the transport amount to perform the second temporary curing integral times. In this instance, the conditions of the temporary curing may be set in consideration of that the dot is fixed integral times of the second temporary curing and the dots are slightly spread at the time of plural times of the second temporary curing. Also, the length of the second temporary-curing irradiation unit 43 may be set as to be the length, in the transport direction, of the lighting region among the length of the second temporary-curing irradiation unit 43 in the transport direction.

As to the Printer

While the printer is described as one example of the apparatus, it is not limited thereto. For example, the same technique as the embodiments can be applied to various kinds of liquid ejecting apparatuses having an application of ink jet technology, such as a color-filter fabricating apparatus, a dying apparatus, a fine machining apparatus, a semiconductor fabricating apparatus, a surface machining apparatus, a 3D modeling device, an evaporator, an organic EL fabricating apparatus (in particular, a polymer EL fabricating apparatus), a display fabricating apparatus, a film forming apparatus, or a DNA chip fabricating apparatus.

As to the Nozzle

In the above embodiments, the ink is ejected by using the piezoelectric element (a piezoelectric element). However, a method for ejecting the liquid is not limited thereto. For example, other methods, such as a method for generating bubbles in the nozzle by using heat, may be used.

As to the Ink

In the above embodiments, the ink (the UV ink) which is cured by irradiation of the ultraviolet rays (UV) is ejected from the nozzle. However, the liquid ejected from the nozzle is not limited to the ink, and a liquid which can be cured by irradiation of other electromagnetic waves (e.g., visible rays) other than UV may be ejected from the nozzle. In this instance, each of the irradiation sections may irradiate electromagnetic waves (visible rays or the like) for curing the liquid.

The entire disclosure of Japanese Patent Application No. 2009-012371, filed Jan. 22, 2009 is expressly incorporated by reference herein.

What is claimed is:

1. A liquid ejecting apparatus comprising:

(A) a carriage that moves a nozzle ejecting a liquid which is cured by irradiation of electromagnetic waves in a moving direction;

(B) a first irradiation section that is installed on the carriage and irradiates electromagnetic waves on dots formed by landing the liquid, which is ejected from the moving nozzle, on a medium; and (C) a second irradiation section that is installed on the carriage at downstream side of the first irradiation section in a transport direction and irradiates electromagnetic waves on the dots which are irradiated by the electromagnetic wave from the first irradiation section.

2. The liquid ejecting apparatus according to claim 1, wherein an irradiance level of the second irradiation section is higher than that of the first irradiation section.

3. The liquid ejecting apparatus according to claim 1, wherein the electromagnetic waves are irradiated from the second irradiation section to suppress the diameter of the dots from being enlarged after the electromagnetic waves are irradiated from the first irradiation section.

4. The liquid ejecting apparatus according to claim 1, wherein the medium is transported in a transport direction intersecting with the moving direction while the nozzle reciprocates in the moving direction, and the second irradiation section is installed farther on a downstream side in the transport direction than a liquid landing region in which the liquid lands on the medium.

5. The liquid ejecting apparatus according to claim 4, wherein the first irradiation section and the second irradiation section are configured in such a way that the irradiance levels of the electromagnetic waves irradiated from any irradiation section at an upstream side region and a downstream side region in the transport direction are different from each other.

6. The liquid ejecting apparatus according to claim 5, wherein a region of the irradiation section, in which the electromagnetic waves are not irradiated, exists between the first irradiation section and the second irradiation section.

7. The liquid ejecting apparatus according to claim 1, wherein the second irradiation section is installed at a position in parallel with the moving direction of the first irradiation section and the nozzle.

8. A liquid ejecting method in a liquid ejecting apparatus including a carriage, a first irradiation section that is installed on the carriage and irradiates electromagnetic waves, and a second irradiation section that is installed on the carriage at downstream side of the first irradiation section in a transport direction and irradiates electromagnetic waves, the liquid ejecting method comprising:

allowing the carriage to move a nozzle ejecting a liquid which is cured by irradiation of electromagnetic waves in a moving direction;

allowing the first irradiation section to irradiate electromagnetic waves on dots formed by landing the liquid which is ejected from the moving nozzle, on a medium; and allowing the second irradiation section to irradiate electromagnetic waves on the dots which are irradiated by the electromagnetic waves from the first irradiation section.

9. The liquid ejecting method according to claim 8, wherein an irradiance level of the second irradiation section is higher than that of the first irradiation section.

* * * * *